US006279364B1

(12) United States Patent
Morphy et al.

(10) Patent No.: US 6,279,364 B1
(45) Date of Patent: Aug. 28, 2001

(54) SEALING METHOD AND PRESS APPARATUS

(76) Inventors: Gary E. Morphy, 82 Rife Avenue, Cambridge, Ontario (CA), N3C 2G7; Thomas E. Bestard, 457 Gladstone Drive, Belmount, Ontario (CA), N0L 1B0; Larry D. Marks, 222 Diefenbaker Drive, Woodstock, Ontario (CA), N4S 8T4

( * ) Notice: Subject to any disclaimer, the term of this patent is extended or adjusted under 35 U.S.C. 154(b) by 0 days.

(21) Appl. No.: 09/249,764

(22) Filed: Feb. 16, 1999

(51) Int. Cl.[7] ..... B21D 9/15; B21D 26/02
(52) U.S. Cl. ..... 72/58; 72/61; 29/421.1
(58) Field of Search ..... 72/58, 61, 62; 29/421.1

(56) References Cited

U.S. PATENT DOCUMENTS

| | | | | |
|---|---|---|---|---|
| 2,465,677 | | 3/1949 | Deverall | 153/80.5 |
| 3,394,569 | | 7/1968 | Smith | 72/56 |
| 4,317,348 | | 3/1982 | Halene et al. | 72/62 |
| 4,567,743 | * | 2/1986 | Cudini | 72/61 |
| 4,761,982 | * | 8/1988 | Snyder | 72/58 |
| 5,022,135 | * | 6/1991 | Miller et al. | 72/58 |
| 5,107,693 | * | 4/1992 | Olszewski et al. | 72/58 |
| 5,233,854 | | 8/1993 | Bowman et al. | 72/58 |
| 5,235,836 | | 8/1993 | Klages et al. | 72/62 |
| 5,445,002 | | 8/1995 | Cudini et al. | 72/62 |
| 5,475,911 | | 12/1995 | Wells et al. | 29/33 T |
| 5,630,334 | * | 5/1997 | Ash | 72/61 |
| 5,644,829 | | 7/1997 | Mason et al. | 29/421.1 |
| 5,735,156 | * | 4/1998 | Yoshitomi et al. | 72/57 |
| 6,006,567 | * | 12/1999 | Brown et al. | 72/58 |
| 6,098,437 | * | 8/2000 | Kocer et al. | 72/55 |

FOREIGN PATENT DOCUMENTS

| | | | |
|---|---|---|---|
| 19812884 | * | 9/1999 | (DE) . |
| 19833006 | | 2/2000 | (DE) . |
| 070264 | | 3/1997 | (EP) . |
| 98/46382 | | 10/1998 | (WO) . |
| 99/03616 | | 1/1999 | (WO) . |

OTHER PUBLICATIONS

Abstract of SU–653–006 Dnepr Metal Inst. "Die for hollow metal blank expansion device" Mar. 28, 1979.

* cited by examiner

*Primary Examiner*—David Jones
(74) *Attorney, Agent, or Firm*—Ridout & Maybee

(57) ABSTRACT

A method and apparatus for sealing the net shape of the end of a final product tube to eliminate or minimize scrap for a wide range of shapes of the end of the product. A sealing tool has a neck, and a coining portion comprising a shoulder extending outwardly from the neck. The sealing tool is inserted into the deformed end of the tube while the end is being laterally engaged by a clamp pressing inwardly against the outer surface of the tube. The end is then sealed by coining a surface of the tube by axially pressing the sealing tool into the end while laterally inwardly pressing the end with the clamp.

23 Claims, 6 Drawing Sheets

SEALING METHOD AND PRESS APPARATUS

FIELD OF THE INVENTION

This invention relates to a method and apparatus especially although not exclusively for use in hydroforming a tubular member. In particular, this invention relates to a method and apparatus for sealing the end of a tube to be hydroformed.

BACKGROUND OF THE INVENTION

The hydroforming process has application in various manufacturing and industrial processes for manufacturing parts used, for example, in automotive manufacturing, in the aerospace industry, and furniture manufacturing and in other instances where a tubular product formed to very precise dimensions and usually possessing properties of strength and lightness is desired.

A conventional hydroforming press apparatus is taught by Bowman et al. in U.S. Pat. No. 5,233,854. However, such a press apparatus is deficient in that burrs on the edges of the starting material tube can damage the O-rings used for sealing, causing the seal unit to leak. Secondly, the portion of the starting tube material extending from the ends of the dies does not usually form part of the finished product, and accordingly must be trimmed away as scrap material. As a result, the cost of manufacturing increases both in terms of the additional materials cost and the time and equipment required to trim away the excess material.

U.S. Pat. No. 5,235,836 to Klages et al. teaches a seal head for tube expansion having elastomeric rings which are protected against damage from burrs. However, as in the Bowman patent, the sealable portion of the tube extending adjacent the seal head may not match the desired shape of the final hydroformed product and must generally be trimmed away as scrap. Furthermore, the elastomeric rings periodically need to be replaced, thereby increasing manufacturing costs.

U.S. Pat. No. 4,761,982 to Snyder teaches a method and apparatus for forming a tube which eliminates the need for elastomeric rings. In the Snyder patent, a widely flaring bell section is formed in each end of the tube that generally must be trimmed away as scrap.

U.S. Pat. No. 5,475,911 to Wells et al. also describes a hydroforming tool which eliminates the need for elastomeric rings and provides wide outward flares on the workpiece outer wall. However, unless it is desired for the outer wall of the ends of the workpiece to be flared outwards, the ends of the workpiece must still be trimmed away as scrap.

Accordingly, there remains a need for a sealing apparatus which can be applied to an end of a workpiece without the need for using elastomeric rings, and that is adapted to be tailored to match a desired shape of the end portion of the product, and that can seal the net shape or desired shape of the final product, thereby eliminating or minimizing the amount of scrap material which must be trimmed away from the ends of the workpiece for a wide range of end shapes.

SUMMARY OF THE INVENTION

In a first embodiment of the present invention, there is provided a method and apparatus for sealing an end of a tubular workpiece without the need for elastomeric rings, by mechanically conforming the end of the workpiece to the desired shape of the end of the final hydroformed product or as closely as possible to that shape.

In accordance with a first aspect of the invention there is provided a method of sealing an end of a tubular workpiece having an initial transverse cross-section, a wall thickness, an inner surface, an interior region bounded by the inner surface, and a pair of opposite ends, the method comprising the steps of:

- providing a sealing tool comprising a neck, and a coining portion comprising a shoulder extending outwardly from said neck;
- deforming one of said opposite ends to provide a deformed end portion having a deformed transverse cross-section different from said initial transverse cross-section; and
- coining said workpiece by axially pressing said sealing tool into said deformed end portion while pressing said one opposite end laterally inwardly and thereby sealing said deformed end portion.

In accordance with a further aspect the invention provides apparatus for sealing an end of a tubular workpiece having an initial transverse cross-section, a longitudinal axis, a wall thickness, an inner surface, an interior region bounded by said inner surface, and a pair of opposite ends, the apparatus comprising:

- a sealing tool including a neck and a coining portion, said coining portion comprising a shoulder extending outwardly from said neck;
- an end forming member disposed transversely to said longitudinal axis and including a cavity having a transverse cross-section different from said initial transverse cross-section;
- first positioning means coupled to said sealing tool for moving said sealing tool along an axis parallel to said longitudinal axis and for performing a sealing step; and
- second positioning means associated with said end forming member for performing a deformation step;
- and wherein said deformation step comprises laterally inwardly pressing said end forming member toward one of said opposite ends to define a deformed end portion having a deformed transverse cross-section different from said initial cross-section, and said sealing step comprising coining said workpiece by axially pressing the sealing tool into said deformed end portion while laterally inwardly pressing said deformed end portion.

BRIEF DESCRIPTION OF THE DRAWINGS

Preferred embodiments of the invention will now be described with reference to the drawings, in which like reference numerals represent like elements, and in which.

DETAILED DESCRIPTION OF THE PREFERRED EMBODIMENT

Figure 1:
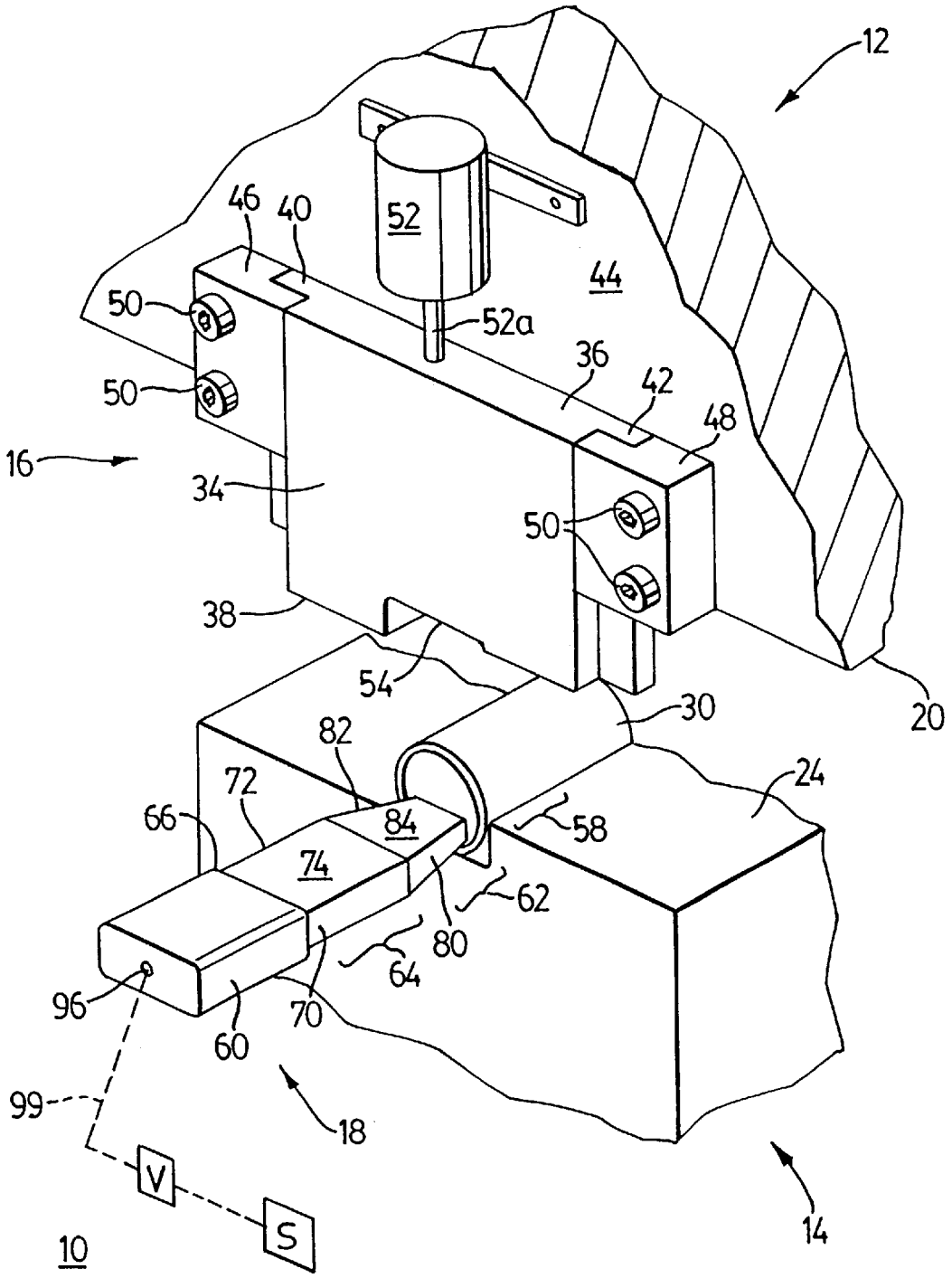
FIG. 1 is a partial perspective view illustrating partly schematically a hydroforming press according to the present invention, showing the ram, the bed, the clamp, the sealing tool, and the tubular workpiece.

Referring to FIG. 1, a press 10 for hydroforming a tubular member is shown comprising a ram 12, a bed 14 (only portions of which are seen in FIG. 1), an end forming member in the form of a clamp 16, and an elongate sealing tool 18. The position of the bed 14 is fixed, and the ram 12 is adapted for movement along a usually vertical axis normal to the bed 14 through conventional controllable hydraulic means (not shown). An upper die 20 is coupled to the bottom portion of the ram 12. An upper die cavity 22 (FIG. 2) is formed in the upper die 20 and extends the length of the die 20. A lower die 24 is coupled on the upper portion of the bed 14 and is adapted to mate with the upper die 20. A lower die cavity 26 (FIG. 2) is formed in the lower die 24 and extends the length of the die 24.

Figure 5:
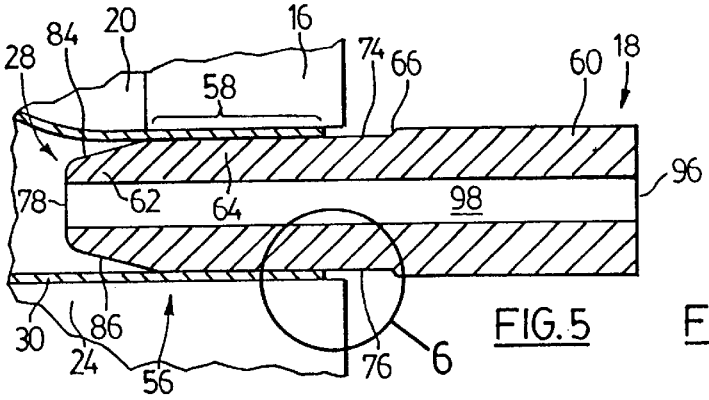
FIG. 5 is longitudinal cross-sectional view of the sealing tool shown in FIG. 1 showing an initial stage of a sealing operation.

When the upper die 20 mates with the lower die 24, the upper and lower cavities 22 and 26 together define an elongate cavity 28 (FIG. 5) for capturing and correspondingly forming a tubular metal workpiece 30. The cavity 28 may often exhibit planar opposing side surfaces. For example, it may be of generally triangular, trapezium, trapezoidal or rectangular cross-section with rounded corners, or it may be of a closed curve cross-section, for example circular or elliptical, or a more complex closed curve cross-section, or may comprise linear and curved portions, in order to form a similarly configured final hydroformed part.

Figure 2:
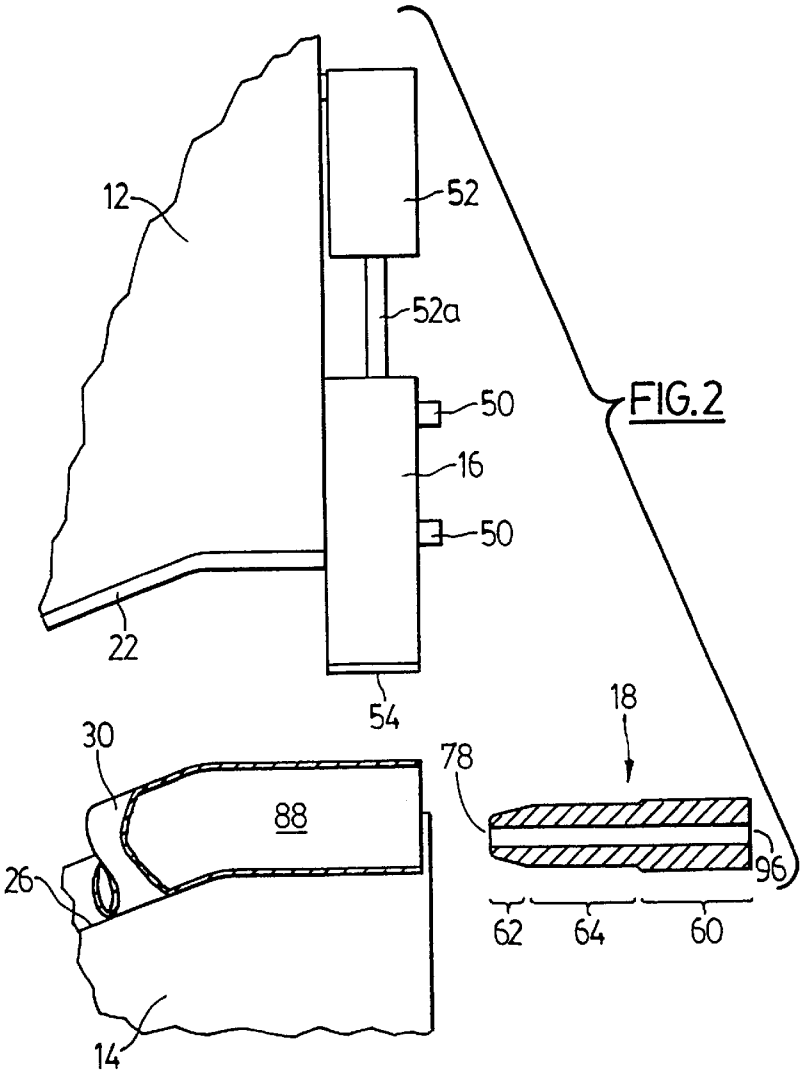
FIG. 2 is a longitudinal cross-sectional view of an end portion of the hydroforming press.

The clamp 16 comprises a substantially rectangular body 34 having a pair of opposite sides, an upper edge 36, a clamping surface 38 provided in the bottom portion of the clamp 16, and a pair of wings 40, 42 extending laterally from the sides. In the example illustrated, the clamp 16 is slidably mounted on an end face 44 of the upper die 20 or ram 12 through L-section guide rails 46, 48. The guide rails 46, 48 are secured to the end face 44 with fasteners 50. The wings 40, 42 are slidably received between the guide rails 46, 48 and the end face 44 to maintain the clamp 16 flush against or parallel to the end face 44 while also allowing the clamp 16 to move in relation to the die 20, along an axis transverse to a longitudinal axis of the elongate cavity 28. Other arrangements for supporting the clamp 16 for movement relative to the ram 12 or die 20 are of course possible. Means are provided for biassing the clamp 16 to a normally displaced position in which the clamp 16 projects downwardly below the die 20. The biassing means may, for example, comprise a gas spring or mechanical springs. In the preferred form, the biassing means comprises a fluid operated, for example pneumatic or, preferably, hydraulic cylinder and piston arrangement that is coupled between the upper die 20 or ram 12 and the clamp 16. For example, a cylinder 52 may be secured to the die 20 or to the end face 44, and a piston working in the hydraulic cylinder 52 has a rod 52*a* that acts on the upper edge 36 of the clamp 16. The supply of pressurized fluid to the cylinder 52 may be regulatable through control means (not shown) for controlling the positioning of the clamp 16 relative to the upper die 20. Alternatively, the cylinder 52 may be permanently pressurized and a relief valve may be provided to allow liquid to exit the cylinder 52 to accommodate relative movement of the clamp 16 with respect to the die 20. Although the clamp 16 is shown in FIGS. 1 and 2 as moving vertically, it should be appreciated that the clamp 16 may move along a line of action normal to or inclined non-perpendicularly to the lower die 24 or bed 14 in a direction inclined to the axis of the ram 12.

In the example illustrated, the clamping surface 38 is adapted to mate with a portion of the lower die 24 located directly below the clamping surface 38. An upper end forming cavity 54 is formed in the clamping surface 38. In the example shown, when the clamping surface 38 presses against the lower die 24, the upper end forming cavity 54 defines together with a portion of the lower die cavity 26 located directly below the clamping surface 38 an end forming cavity 56 (FIG. 3) for capturing an end portion 58 of the tubular workpiece 30. The cavity 56 preferably forms a smooth transition axially with the elongate cavity 28 and cooperates with the cavity 28 to define a desired shape for the end portion 58 of the workpiece 30. As a result, the entire end portion 58 need not be trimmed away as scrap. As will be apparent to those skilled in the art, the lower portion of the end forming cavity 56 may be formed by an end forming member other than a portion of the lower die cavity 26, for example by an upper portion of a lower clamp device similar to and opposing clamp 16 and mounted for vertical movement on the bed 14 or lower die 24 in a manner similar to the above-described mounting and positioning of the clamp 16 on ram 12 or upper die 20.

It will be appreciated that the end forming cavity 56 may have any of a wide variety of shapes to satisfy the required final shape of the tubular member.

In the example shown in FIGS. 1 to 8, the elongate sealing tool 18 comprises a base 60 and a tapered tip 62. The tapered tip 62 may, however, be omitted. The tool 18 further comprises a neck 64 extending forwardly from the base 60, and a coining portion 66 positioned between the base 60 and the neck 64. In this example, the neck 64 and base 60 are similar in cross-section to the end forming cavity 56 and the desired final shape of the end portion 58. In the example illustrated, wherein the desired final shape is rectangular, for example, the neck 64 comprises generally parallel planar side walls 70, 72 and faces 74, 76 connected through rounded corner edges. The tapered tip 62 includes a fluid flow port 78 opening at the leading end of the tool 18, and tapers smoothly from the forward end of the neck and in this example comprises generally planar side walls 80, 82 and faces 84, 86 connected to each other and to the neck 64 through smoothly rounded edges thereby providing the sealing tool 18 with a transverse cross-sectional area which is greater at the neck 64 than at the leading end of the sealing tool 18. The tapered tip 62 may assist in forming the end portion 58 of the workpiece 30 by pushing it outward from the inside when advanced into the workpiece 30 as described later.

Figure 6:
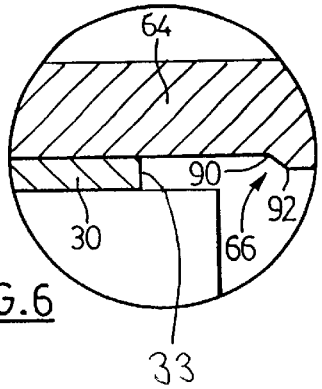
FIG. 6 is a magnified view of the coining portion of the sealing tool shown in FIG. 5.

As shown in FIG. 6, the coining portion 66 includes an inner flank 90 and a coining edge 92, and is continuous around the entire circumference of the sealing tool 18. Preferably, the coining portion 66 comprises a shoulder which inclines outwards at the neck 64 rearwardly towards the base 60.

The sealing tool 18 as seen in FIGS. 1 and 2 also includes a rear fluid flow port 96 provided in the base 60, and a fluid passageway 98 (FIG. 5) which extends between the ports 96 and 78. As shown somewhat schematically in FIG. 1, the sealing tool 18 may be coupled at the port 96 through valving V to a high pressure fluid source S along a line 99. The sealing tool is also coupled to a positioning means, for example a horizontally operating conventionally controllable hydraulically operated piston and cylinder arrangement (not shown), for moving the sealing tool 18 along an axis parallel to the longitudinal axis of the cavity 56 between retracted (FIG. 2), intermediate (FIG. 3) and advanced (FIG. 7) positions.

As will be appreciated, when the tubular workpiece 30 is to be hydroformed, it is necessary to fill fluid, usually water, into the interior of the tubular workpiece 30. In the example illustrated in FIGS. 1 to 10, the fluid passageway 98 is relatively narrow. As a result, the flow rate of fluid through the fluid passageway 98 is low. It will be appreciated that a wide passageway 98 may be employed so that a satisfactorily high flow rate may be achieved through the passageway 98. Where, however, the passageway 98 is narrow, to facilitate shorter filling times, a fast fill shroud (not shown) may surround the sealing tool 18 to provide a low pressure/high flow rate fluid path to the interior of the tubular workpiece 30. Each such shroud may include a large diameter low pressure conduit communicating through valving with a low pressure/high volume flow rate fluid dispensing means and the interior of the shroud. The interior of the tubular workpiece 30 is first rapidly filled with fluid through the shroud and the high flow rate fluid dispensing means. After the tubular workpiece 30 is substantially filled, the process of hydroforming is commenced by sealing the workpiece 30 at each end, isolating the interior of the workpiece 30 from the low pressure dispensing means, and pressurizing the fluid therein by applying a high pressure through the fluid passageway 98.

Suitable low pressure/high flow fast fill shrouds are taught in commonly assigned U.S. Pat. No. 5,235,836 to Klages et al. which relates to a horizontally reciprocable shroud and in U.S. Pat. No. 5,445,002 to Cudini et al which relates to a horizontally split box type shroud. The disclosures of both these patents are hereby incorporated herein by reference. The shroud includes an interior communicating with the low pressure/high volume fluid dispensing means, a communication between the forward end of the shroud and the outer end of the end forming 56, and an O-ring seal provided at a rearward end of the shroud within which the tool 18 is reciprocable while preventing rearward fluid leakage between the shroud and the base 60 of the sealing tool 18. When the sealing tool 18 is advanced sealingly within the end portion 58, the shroud and low pressure dispensing means are isolated from the high pressure created within the workpiece 30. In the case in which a horizontally reciprocable shroud is used, the shroud may be coupled to positioning means for advancing and retracting the shroud sealingly toward and away from the outer end of the clamp 16 and of the member defining the lower portion of the end forming cavity, for example the lower die 24. In the case in which a split box type shroud is employed, the shroud may comprise upper and lower portions connected to the clamp 16 and to the lower end forming member, for example the lower die 24, or lower clamp if present, respectively. These portions seal together in a closed position of the clamp 16 relative to the lower end forming member.

One form of process by which a tubular member is hydroformed using the press 10 will now be described. Referring again to FIG. 1, a tubular workpiece 30, which may be pre-bent to a desired general form, is placed on the lower die 24 with a lower portion of the workpiece 30 disposed within the lower die cavity 26, preferably with its end edges 33 as seen in FIG. 6 disposed adjacent an outer face of the clamp 16, whereupon the hydraulic means is activated to bring the ram 12 from an open position as seen in FIG. 1 to a partially closed position wherein the upper die 22 is in close proximity to but spaced from the lower die 24.

In the partially closed position of the ram 12, the upper die 20 may be vertically displaced a distance from the outer surface of the tubular workpiece 30. Preferably, however, in the partially closed position the workpiece 30 is compressively gripped between the upper and lower dies 20 and 24 to resist longitudinal displacement of the workpiece 30 by reaction with the tool 18, or deformation during subsequent pre-pressurization, if employed. In the case in which the clamp 16 is not permanently biassed downwardly relative to the die 20, the pressure in the cylinder 52 at this stage may be controlled so that the clamp 16 is vertically displaced below the upper die 22 as seen in FIG. 1. As a result, the clamp 16 closes on the lower die 24 as seen in FIGS. 3 and 4 and the end portion 58 of the tubular workpiece 30 is clamped within and captured in the end forming cavity 56.

As the clamp 16 closes together with the lower die 24 these members will usually deform the end portion 58 of the workpiece 30 from its initial cross-section preferably to a final cross-section desired for the hydroformed part. This cross-section corresponds to that of the end forming cavity 56. For example, the end portion may be deformed from a circular to an oval cross-section, or vice versa, or from an oval or circular cross-section to a generally square, rectangular, triangular, trapezium, trapezoidal or other polygonal cross-section with rounded corners that may be sharply radiused. Various other cross-sections are of course possible. For example, the cross-section may comprise both linear and curved portions. Significantly, the shape of the deformed end portion 58 is not limited to simply curved cross-sections but may be of relatively complex cross-section including linear-profiled and tightly radiused portions that could not readily be sealed with an elastomeric seal. In this manner, the workpiece can be formed along its entire length including its end portions with a desired final configuration without needing to separately form end portions with oval, circular or other simply curved cross-sections that lend themselves to elastomeric sealing purposes and that have to be cut off and discarded before use of the hydroformed part. In the event that the desired end portion is of exceptionally complex cross-section so that it cannot be sealed in accordance with the present invention, the sealing procedure of the invention allows the cross-section of the sealed end portion to be tailored to correspond to or closely match the desired cross-section with only a short transition section so that wastage of metal may be eliminated or at least greatly reduced.

Figure 3:
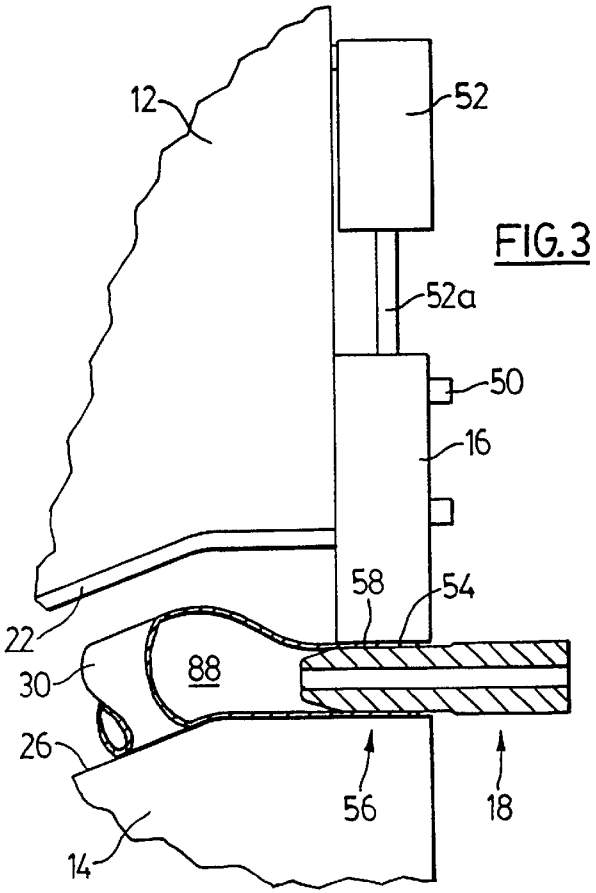
FIG. 3 is a view corresponding to FIG. 2 at the end of the deforming step.
Figure 4:
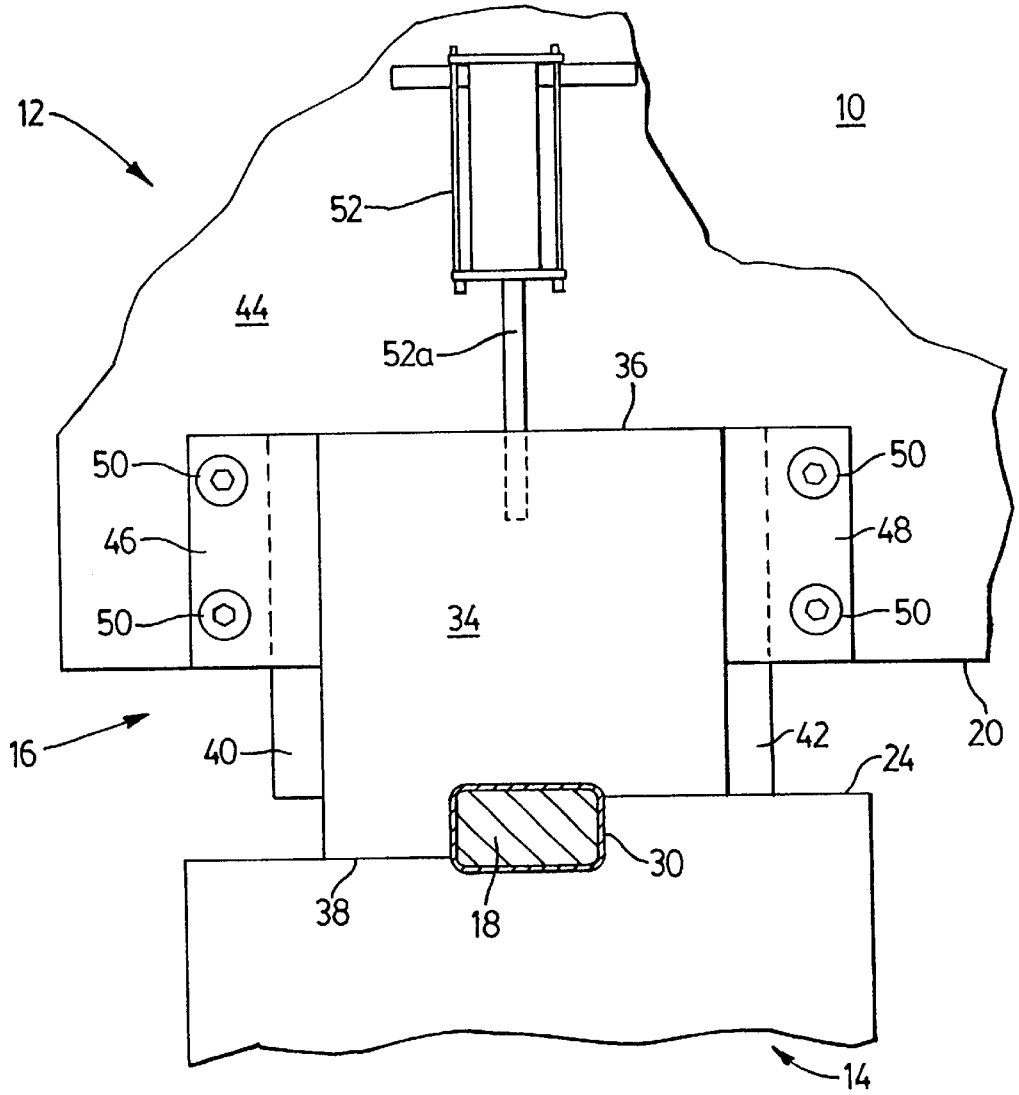
FIG. 4 is a front view partially in section of the hydroforming press at the end of the deforming step.

Before, during or after the closure of the clamp 16 from the FIG. 2 to the FIG. 3 position, the tool 18 is advanced to a position as seen in FIG. 3 wherein the tapered portion 62 and a portion of the neck 64 enter the workpiece 30.

A function of the clamp 16, apart from deforming the end portion 58 as described above may be to engage the end portion 58 frictionally so as to resist axial thrust forces exerted by the tool 18 during coining insertion within the workpiece 30 so that the workpiece 30 is not crumpled or shifted bodily inwardly relative to the upper and lower dies 20 and 24 when the tool is advanced into the workpiece, especially in cases in which gross deformation results in view of gross discrepancies between the cross-sections of the starting tube and of the desired final product. The function of the tool 18, apart from sealing the end portion 58 as described in more detail below, may be to support the workpiece 30 internally against undesired inward deformations, for example pronounced longitudinal corrugation or creasing that may occur when the clamp 16 moves to its closed (FIG. 3) position, and that may be difficult to eliminate in subsequent processing, again especially in cases in which there is gross deformation as a result of gross discrepancies between the starting material and desired final cross-sections.

Hence, in cases in which there is no acute deformation, for example in the case in which a circular starting tube is deformed to an elliptical cross-section product or vice versa, it will usually be possible to deform the end portion 58 by closing the clamp 16 in the absence of the tool 18, or, if desired, by inserting the tool 18 while the clamp 16 remains at least partially open, for example in the open (FIG. 2) position, and one of these procedures may be preferred in some manufacturing processes since it may reduce processing or cycle times. However, in some cases, the use of a fast fill shroud as described above may reduce cycle times.

In the example illustrated in FIGS. 1 to 8 of the drawings, it is desired to deform the end portion 58 from an initial circular cross-section to a final generally rectangular cross-section and to support the workpiece 30 both internally and externally during the course of this deformation. In the example of FIGS. 1 to 8, usually, during the course of closure of the clamp 16 from the open (FIG. 2) to the closed (FIG. 3) position, the positioning means is activated to advance the sealing tool 18 towards the end portion 58 of the workpiece 30, along an axis parallel to the longitudinal axis of the elongate and end forming cavities 28 and 56. As the sealing tool 18 advances from the FIG. 2 to the FIG. 3 position, the tapered tip 62 and the neck 64 of the sealing tool 18 enter the interior region 88 of the workpiece 30, and the end portion 58 begins to be deformed by the inward lateral pressure exerted by the clamp 16 and lower die 24 against the outer surface of the tubular workpiece 30. Any tendency for axial movement of the tubular workpiece 30 induced by the advance of the sealing tool 18 is resisted by friction between the clamp 16 and lower die 24 and the outer surface of the workpiece 30.

Figure 14:
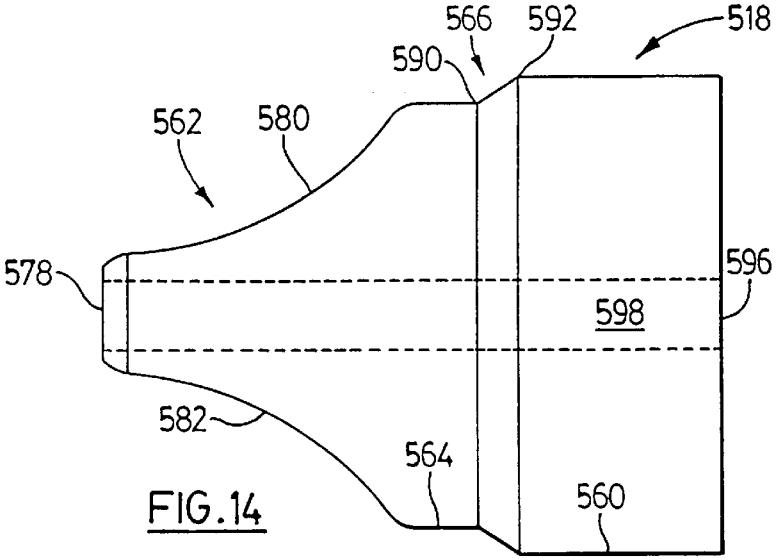
FIG. 14 is a top view of a further modified form of sealing tool.
Figure 13:
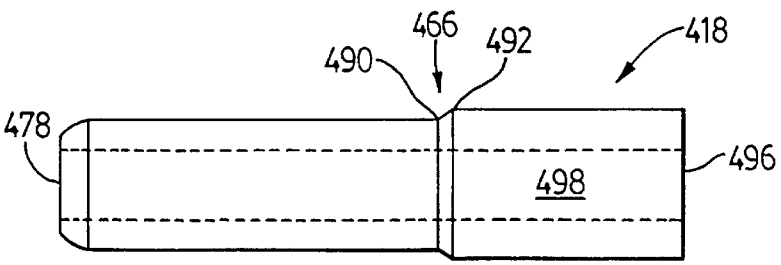
FIG. 13 is a side view of the tool shown in FIG. 12.

The closure of the clamp 16 and the advance of the sealing tool 18 continue until the shape of the end portion 58 is substantially similar to the shape of the end forming cavity 56 and to the transverse cross-section of the neck 64 adjacent the base portion 90. That is to say these elements are similar in that they are of the same shape and may differ in size. This point, which, in the example illustrated, is shown in FIGS. 13 and 14, signifies the end of the deformation step and is reached when the upper clamping surface 38 contacts the lower pressing surface 24.

In the example illustrated, when it is desired that the end portion 58 be subjected to zero expansion during the deformation step, the periphery of the neck portion 64 should be equal to or slightly less than the periphery of the inner circumference of the starting material tube 30. Preferably, there is a clearance of at least about 0.001 inches (about 0.03 mm) between the surfaces of the neck portion and the inner surfaces of the deformed end portion 58. The periphery of the inner circumference of the end forming cavity 56 should preferably be equal to the nominal periphery of the outer circumference of the starting material tube 30. Usually, no regard is paid to the manufacturer's tolerances in the starting material tube outside diameter. With regard to the wall thickness, usually the dimensions of the apparatus are based on the minimum wall thickness of the workpiece. Usually, the wall thickness tolerance is specified by the manufacturer as positive only, for example −0.0+0.008 inches and in such case the design may be based on the nominal wall thickness. The manufacturer's tolerances are normally relatively small and can be accommodated by small deformations of the end portion 58. In the event the outside dimension of the workpiece 30 is greater than nominal, the clamp 16 and lower member such as lower die 24 slightly compress the end portion 58 and conform it to the nominal dimension when they close together. In the event the inside dimension is less than nominal, the sealing tool 18 slightly expands the workpiece 30 when it is inserted and conforms the workpiece 30 to the nominal internal dimension. Usually, therefore the design is based on the nominal outside dimension and the minimum wall thickness of the starting tube workpiece 30.

In the event that a fast fill shroud is used, at the end of the deformation step, the sealing tool 18 is retracted partially from the tubular workpiece 30 and relative to the fast fill shroud so as to create a passageway between the inner surface 31 of the tubular workpiece 30 and the sealing tool 18. The interior region 88 of the tube 30 is then rapidly filled with fluid from the low pressure/high flow rate fluid dispensing means through the lower pressure conduit and shroud. The O-ring seal provided at the rearward end of the shroud prevents rearward low pressure fluid leakage between the shroud and the base 60 of the sealing tool 18. The opposite end of the tubular workpiece 30 may at this point be sealed by a sealing tool and clamp arrangement similar to that described above with reference to FIGS. 1 to 8, or by a plug means of the type known by those skilled in the art.

After the tubular workpiece 30 is filled with fluid, the tool 18 is advanced to perform a coining and sealing step which seals the sealing tool 18 to the end portion 58 of the workpiece 30. During the sealing step, pressure continues to be applied to cylinder 52 to maintain lateral pressure exerted by the clamp 16, and the sealing tool 18 is advanced towards the workpiece 30 until the coining edge 92 presses against the end 33 of the workpiece 30.

In the embodiment illustrated in FIGS. 5 to 8, the distance between the inner flank 90 and the coining edge 92 of the tool 18 is preferably less than the wall thickness of the tubular workpiece 30, and is preferably at most about 75% of the wall thickness of the deformed tubular workpiece 30, based on the tube's minimum wall thickness.

Figure 7:
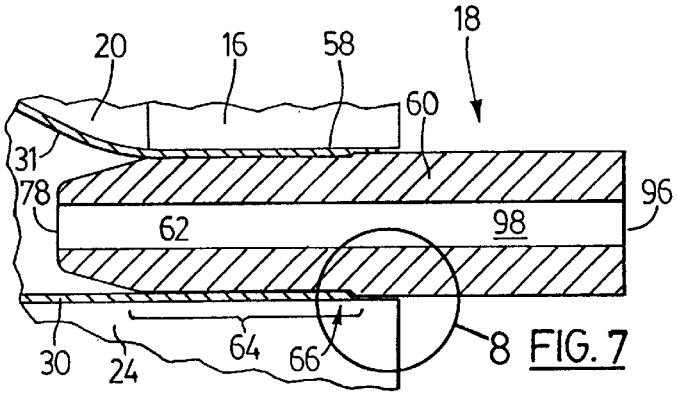
FIG. 7 is a longitudinal cross-sectional view showing a later stage in the sealing operation.
Figure 8:
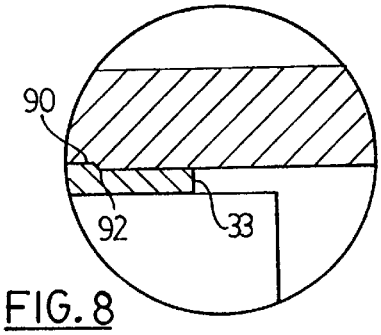
FIG. 8 is a magnified view of the coining portion of the sealing tool-shown in FIG. 7.

The positioning means for the sealing tool 18 is then actuated to press the tool 18 a short distance past the end 33 into the end portion 58, causing the coining portion to coin a short section of the end portion 58 of the workpiece 30 by thinning it. This step is shown in FIGS. 7 and 8. The width of the base portion 60 rearwardly of the coining edge 92 is such that the coining operation reduces the wall thickness of the deformed end portion 58 of the workpiece 30. Since the coining portion 66 is continuous around the periphery of the tool 18 and the inner surface 31 of the workpiece 30 is held pressed against the base 60 and the neck 64 of the sealing tool 18 by reaction with the surfaces of the second cavity 56, the coining operation results in a continuous shoulder being formed around the inner surface 31 at which there is a strong compressive reaction between the tool 18 and the workpiece 30, thereby producing a leak-resistant end seal between the end portion 58 and the sealing tool 18 capable of withstanding subsequent internal pressures within the workpiece 30. In order to retain the tool 18 in the sealing position and to resist the force of internal fluid pressure tending to displace the tool 18 outwardly, locking means may applied to the tool. Such locking means may for example comprise wedges inserted laterally to engage the tool 18 and thrust it slightly inwardly to complete the coining and sealing of the workpiece. The wedges block any tendency for retraction. Alternatively, locking gates, such as the backstop means or blocks disclosed in commonly assigned U.S. Pat. No. 5,235,836 (Klages et al), may be applied to the tool 18. The disclosure of U.S. Pat. No. 5,235,836 is incorporated herein by reference in this regard.

Preferably, the coining step reduces the wall thickness of the workpiece 30 at least about 0.0001 inch and up to about 0.050 inch (about 0.003 to about 1.3 mm). Reductions in thickness less than about 0.0001 inch may result in insufficient resilient reaction between the coined workpiece 30 and the tool 18 so that a completely leak-tight seal is not achieved. Reductions in wall thickness greater than about 0.050 inch may require excessive expenditure of energy, may subject the apparatus to excessive mechanical stresses, and may exert axial thrust that the clamp 16 is incapable of resisting so that the workpiece may be pushed axially through or displaced axially relative to the clamp 16. Further, excessive rates of wear of the tool 18 may be produced. More preferably, the reduction in wall thickness due to coining is about 0.0015 inch to about 0.015 inch (about 0.04 to 0.4 mm) and still more preferably about 0.002 to about 0.011 inch (about 0.05 to about 0.33 m).

Instead of having a coining portion that extends in a single step from the neck portion 74 to the base portion 60, the tool 18 may have a coining portion that comprises a plurality of steps, so that the inside of the workpiece is coined to form it with a series of steps. In such case the preferred reductions in wall thickness discussed above refer to the aggregate or sum of all the reductions in wall thickness effected by these steps between the neck portion 74 and the base portion 60.

When selecting the dimensions of the base portion 60, usually regard will be paid to the tolerances in the wall thickness of the workpiece 30 in order to achieve a desired degree of reduction in the wall thickness that produced an adequately fluid tight seal. For example, if the width of the end forming cavity 56 is 2 inches (50.8 mm) and the original wall thickness is 0.060 inches (1.524 mm) with a tolerance of −0.0+0.008 inches (−0.0+0.2032 mm) the base portion 60 may have a width of 1.886 inches (47.9044 mm) so that the coining operation will produce a wall thinning of between 0.003 and 0.011 inches (between 0.0762 and 0.2794 mm).

It may be noted that in the coining and sealing steps, the tool 18 is in direct metal to metal contact with the workpiece 30, thus avoiding the problems and limitations associated with elastomeric seals. In order to reduce the rate of wear of the tool 18, it may be hardened by any conventional hardening method.

During the coining and end sealing operation, and during the step of fully closing the die 20 on the lower die 24, pressure is maintained in the cylinder 52 sufficient to resist the tendency for the clamp 16 to be forced upwardly. For example, a pressure relief valve may be connected to the cylinder 52 and set such that, while maintaining a desired pressure, fluid may be exited from the cylinder sufficiently to accommodate the coining and die closure operations while maintaining the clamp 16 pressed tightly against the lower die 24.

If necessary or desired, an internal pre-pressurization of the workpiece 30 may then be conducted by connecting the fluid inlet port 96 to a source of high pressure. This pre-pressurization is less than the final hydroforming pressure and the procedure and the advantages thereof are described in more detail in commonly-assigned U.S. Pat. No. Re. 33,990 (Cudini) the disclosure of which is incorporated by reference herein. Briefly, the pre-pressurization allows the workpiece 30 to be received in a complexly configured or somewhat small cross-section die cavity while avoiding problems of undesired or detrimental deformation, for example as a result of pinching of the workpiece 30 between the upper and lower dies 20 and 24 externally of the elongate cavity 28. Once the pre-pressure is applied, or immediately following the coining and end sealing operation in the event that pre-pressure is not applied, the ram 12 is operated to lower the upper die 20 and fully close it on the lower die 24 and capture the workpiece 30 in the upper and lower die cavities 22 and 26. High pressure is applied through the port 96 to cause the workpiece 30 to hydroform, that is to say to conform intimately to the interior surfaces of the cavity 28, wherein the interior surfaces of the cavity 28 press inwardly on and define the final shape of the workpiece. As a result, the circumference of the starting material tube workpiece 30 may expand from about zero to about 100%. During the pre-pressure step, if used, and the hydroforming step, axially inward pressure is maintained on the tool 18 through its positioning means sufficient to withstand the axially outwardly directed thrust.

The high pressure is then relieved, the tool 18 retracted to the FIG. 2 position, the reciprocable fast fill shroud, if present, is retracted, and the ram 12 and clamp 16 lifted to the FIG. 2 position to allow the hydroformed workpiece to be exited from the apparatus. A fresh tube workpiece 30 may then be placed on the lower die 24 and the above cycle of operation repeated.

In the case in which a fast fill shroud is not present, the workpiece after end sealing may be filled and pressurized through the passageway 98, without needing to retract the tool 18 from the workpiece 30 until after completion of the hydroforming cycle.

In the case in which the tool 18 is introduced to the FIG. 3 position before the clamp 16 is closed, the above described procedure is followed except the clamp 16 is closed before fast filling, if used, or before the coining and end sealing in the event a fast fill shroud is not employed.

In the case in which the clamp 16 is closed before the tool 18 is inserted, the above procedure may be modified by fast filling, if used, while the tool 18 remains retracted, or by coining to end seal the tube and filling through the passageway 98 in the event that a fast fill shroud is not employed.

As will be appreciated, control of the operation of the ram 12, of retraction and advance of the tool 18, of the pressurization of the cylinder 52 and hence of movement of the clamp 16, of the reciprocable fast fill shroud, when present, and of the valving associated with the fast fill shroud and with the high pressure source connected to the passageway 98, may be effected manually but normally will be controlled automatically by conventional control means operated according to a timed cycle.

Various modifications to the above are of course possible. For example, the sealing tool 18 may expand the end portions 58 of the workpiece 30. In such case, the above described procedure is modified in that the periphery of the neck portion 64 of the tool 18 is substantially greater, for example up to about 20% greater, than the inner periphery of the workpiece 30, and the dimensions of the end forming cavity 56 defined by the clamp 16 and lower die 24 or other end forming member are such that they snugly receive the exterior of the expanded end portion of the workpiece 30. In order to resist the axial thrust generated during the step of expansion of the end portion of the workpiece 30 by insertion of the neck portion 64 of the tool 18, an opposite end of the workpiece 30 may be gripped or blocked from movement, for example by opposing it with an abutment member, or a similar expanding tool 18 may be simultaneously inserted into the opposite end of the workpiece 30, or an intermediate portion of the workpiece 30 may be gripped between the upper and lower dies 20 and 24 in partly closed position.

Figure 9:
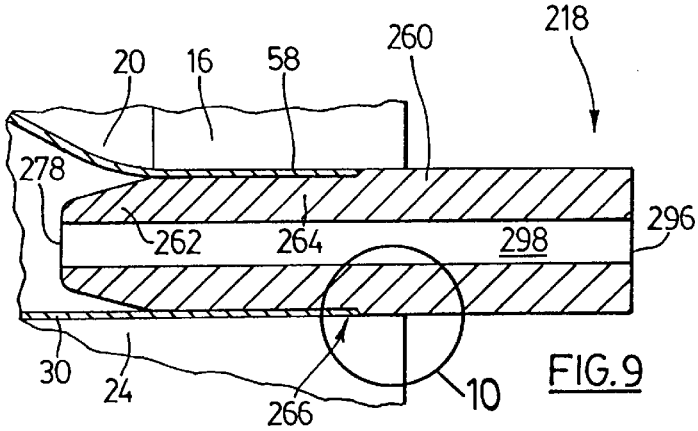
FIG. 9 is a longitudinal cross-sectional view corresponding to FIG. 7 and showing use of a modified sealing tool.
Figure 10:
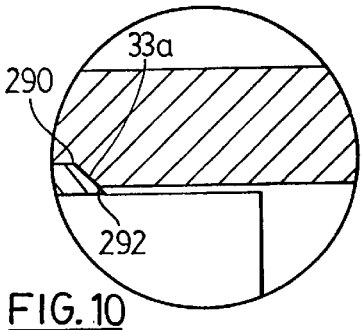
FIG. 10 is a magnified view of the coining portion of the sealing tool shown in FIG. 9.

In another variation, a sealing tool 218 shown in FIGS. 9 and 10 may be used. The sealing tool 218 is similar to the sealing tool 18, and like parts are denoted by similar reference numerals raised by 200. However, in contrast to the sealing tool 18, the distance between the inner flank portion 290 and the coining edge 292 is preferably slightly less than the wall thickness of the tubular workpiece 30, and the width of the base portion 260 is such that the tool 218 coins an end face of the deformed end portion 58.

The procedure for using sealing tool 218 is as described above with reference to tool 18 except in the coining step it is pressed into the end 33 of the end portion 58 sufficiently to cause the coining edge 292 to coin only the end face 33 of the end portion 58. This step is shown in FIGS. 9 and 10. This forms an internal flare seal wherein the end surface of the tube 30 is deformed and thinned non-uniformly to provide it with an angled face 33*a* and creating a seal between the coining portion extending between the portions 290 and 292 and the angle face 33*a*. The remainder of the procedure is as described above in relation to tool 18.

Figure 11:
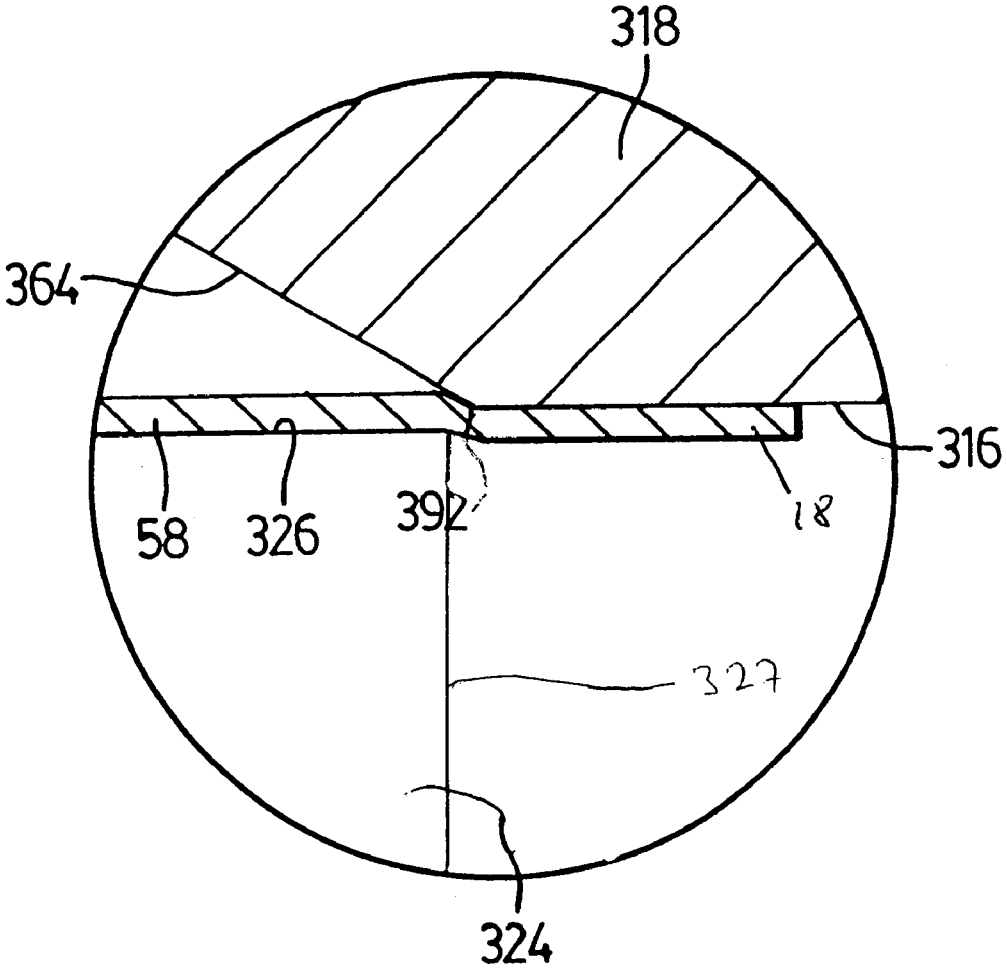
FIG. 11 is a magnified view similar to FIG. 6 showing use of a further modified sealing tool and clamping device.

FIG. 11 shows a further modification in which a sealing tool 318 has a base portion 316 of width somewhat greater than the inner width of the deformed end portion 58, but less than the outside width of the portion 58, and a neck portion 364 that tapers inwardly from a coining edge 392. The end forming members, for example an upper clamp similar to clamp 16, or a lower clamp, or an end forming portion of the lower die 324, as shown, has an inner side 326 extending parallel to the outer side of the base portion 316 and to the axis of the deformed end portion 58, and an end portion 327 that extends transversely outwardly from the inner side 326. In the coining and sealing step, wherein the outer side of the deformed end portion is engaged by the end forming members and the tool 318 is forcefully pressed axially inwardly into the deformed end portion 58, the wall of the end portion 18 is flared slightly axially rearwardly from the end portion 327 and is pinched and thinned between the coining edge 392 and the inner side 326, as seen in FIG. 11.

The sealing tools 18 and 218 described above with reference to FIGS. 1 to 10 provide internal support for the workpieces 30 in that during the deformation step, the neck 64, 264 supports the end portion 58 of the workpiece 30 along its entire inner surface 31. Therefore, the sealing tools 18 and 218 are useful for applications requiring exceptionally severe deformation of the workpiece 30. However, since the tapered tip 62, 262 includes generally planar side walls and faces, the sealing tools 18 or 218 must be retracted from the workpiece 30 at the end of the deformation step if fast fill is to be employed, so that fluid may enter the interior 88 between the tool 18 or 218 and the workpiece 30. This retraction step may increase the time required to produce the finished tubular member.

Figure 12:
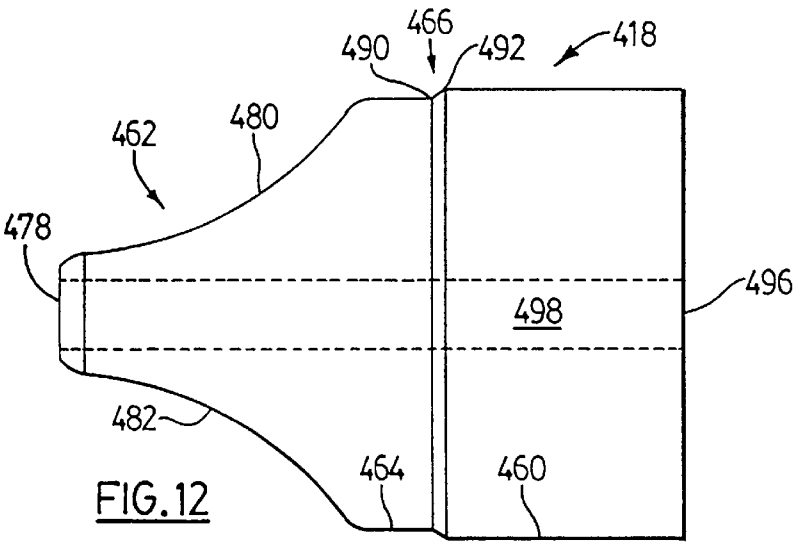
FIG. 12 is a top view of a further modified form of sealing tool.

To allow for more rapid filling of the workpiece 30, a modified sealing tool 418 (FIGS. 12 and 13) may be used. The sealing tool 418 is similar to the sealing tool 18 and comprises a base 460, a tapered tip 462, a neck 464 extending between the base 460 and the tapered tip 462, a continuous coining portion 466 positioned between the base 460 and the neck 464 and including an inner flank portion 490 and a coining edge 492, a fluid flow port 478 provided in the tapered tip 462, a fluid inlet port 496 provided in the base 460, and a fluid passageway 498 extending between the fluid ports 496 and 478. However, in contrast to the sealing tool 18, the neck 464 may be shortened, and the tapered tip 462 includes a pair of opposing concave side walls 480, 482 extending from the leading end of the sealing tool 418 to the neck 464 to give the sealing tool 418 a progressively greater transverse cross-sectional area near the neck 464 than near the leading end.

In use, after placing the workpiece 30 in the press, preferably the tool 418 is inserted into the workpiece 30 during the step of closing together the end forming members such as clamp 16 and lower die 24 to deform the end portion 58. An opposite end of the workpiece 30 is sealed. Fast filling may then be commenced through an exterior fast fill shroud. Initially, the tool 418 is inserted approximately to the extent indicated in FIG. 5, so that the neck 464 does not enter the workpiece 30. Since there is a gap between the end of the workpiece 30 and each side wall 480, the workpiece can be and preferably is fast filled through these gaps. The tool 418 is then inserted to the extent indicated in FIG. 7 in order to coin and seal the end of the workpiece. Prepressurization, die closure and hydroforming can then follow in the manner generally as described above in detail with reference to FIGS. 1 to 8. During initial insertion of the tool 418, the tapered tip 462 mechanically smooths out the deformed end portion 58 from the interior so as to avoid undesired corrugations or indentations that might otherwise be introduced into the end portion during closure of the end forming members, and that might be difficult to remove by application only of internal fluid pressure. Since the tool 418 of FIGS. 12 and 13 allows for a shorter process cycle over the tool 18 of FIGS. 1 to 8, because it does not require a step of retraction to achieve fast filling, it is generally preferred over the tool 18.

Figure 15:
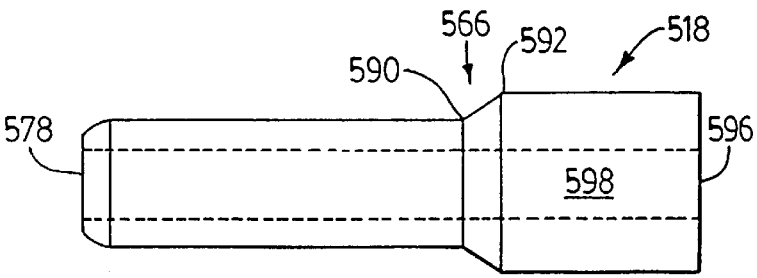
FIG. 15 is a side view of the tool shown in FIG. 14.

Turning to FIGS. 14 and 15, a sealing tool 518 is shown, somewhat similar to tool 418. Like parts are denoted by like reference numerals raised by 100. In this case, however, the distance between the inner flank portion 590 and the coining edge 592 is slightly less than the wall thickness of the workpiece 30, and the tool 418 may be used in the manner described above with reference to tool 218 except again the sealing tool 518 does not have to be retracted from the workpiece 30 to achieve a fast filling step.

It is to be understood that the description of the preferred embodiments is not intended to be exhaustive of the present invention. Those of ordinary skill will be able to make certain additions, deletions and/or modifications to the disclosed embodiments without departing from the spirit or scope of the invention, as defined by the appended claims.

What is claimed is:

1. A method of sealing an end of a tubular workpiece having an initial transverse cross-section, a wall thickness, an inner surface, an interior region bounded by the inner surface, and a pair of opposite ends, the method comprising the steps of;

providing a sealing tool comprising a neck, and a coining portion comprising a shoulder extending outwardly from said neck;

deforming one of said opposite ends to provide a deformed end portion having a deformed transverse cross-section different from said initial transverse cross-section;

coining said workpiece by axially pressing said sealing tool into said deformed end portion while pressing said one opposite end laterally inwardly and thereby sealing said deformed end portion;

the sealing tool comprising a base portion rearwardly of said coining portion of transverse width greater than an inner transverse width of said deformed transverse cross-section; and said coining step comprising engaging an end surface of said one opposite end with said coining portion while maintaining said base portion axially outwardly from said end surface of said one opposite end.

2. A method as claimed in claim 1, wherein said deforming step comprises forcing said neck into said interior region while laterally pressing said one opposite end toward said neck.

3. A method as claimed in claim 1 wherein said step of deforming said one opposite end comprises providing an end forming member, and urging said end forming member transversely inwardly toward said one opposite end.

4. A method as claimed in claim 3 wherein said end forming member has an inner side engaging said one opposite end, said inner side extending parallel to an axis of said one opposite end.

5. A method as claimed in claim 1 wherein said coining step comprises inserting said base portion axially inwardly with respect to said inner side of said end forming member and said one opposite end.

6. A method as claimed in claim 1 wherein said end forming member has an end portion extending transversely outwardly from said inner side, and wherein said coining step comprises inserting said neck portion axially inwardly with respect to said end portion of said end forming member and said one opposite end and pinching said tubular workpiece between said coining portion and said inner side.

7. A method of sealing an end of a tubular workpiece having an initial transverse cross-section, a wall thickness, an inner surface, an interior region bounded by the inner surface, and a pair of opposite ends, the method comprising the steps of:

providing a sealing tool comprising a neck, and a coining portion comprising a shoulder extending outwardly from said neck;

deforming one of said opposite ends to provide a deformed end portion having a deformed transverse cross-section different from said initial transverse cross-section;

coining said workpiece by axially pressing said sealing tool into said deformed end portion while pressing said one opposite end laterally inwardly and thereby sealing said deformed end portion; and said coining step causes a reduction in said wall thickness about 0.0001 to about 0.050 inch (about 0.003 to about 1.3 mm).

8. A method as claimed in claim 7 wherein said reduction in thickness is about 0.0015 to about 0.015 inch (about 0.04 to about 0.4 mm).

9. A method as claimed in claim 8 wherein said reduction is about 0.002 to about 0.011 inch (about 0.05 to about 0.3 mm).

10. A method of sealing an end of a tubular workpiece comprising:

(a) providing a die;

(b) providing a tubular workpiece having thereon an end portion having an initial cross section transverse to the longitudinal axis of the tubular workpiece;

(c) deforming the end portion of said tubular blank and providing it with a deformed end portion having a deformed cross section transverse to the longitudinal axis of the tubular blank different from said initial cross section;

(d) sealing said blank by applying to said deformed end portion a sealing tool comprising a neck and a coining portion comprising a shoulder extending outwardly from said neck, and coining said workpiece by axially pressing said sealing tool into said deformed end portion while pressing said end portion laterally inwardly; and wherein in said step of providing a die, said die comprises die sections moving between open, intermediate and closed positions, each die section having a die cavity portion and a mating surface portion, which die sections in the closed position have the mating surface portion of each section in mating engagement with the mating surface portion of each adjacent section, and said step of deforming said end portion of said tubular blank comprises placing the blank between the die sections in the open position, and partially closing the die sections to said intermediate position for deforming said end portion, and wherein said sealing tool is inserted into the deformed end before said die sections are moved to the closed position.

11. A method as claimed in claim 10 wherein, in said step of providing a die, at least one die section has a clamp member connected movably thereon, said clamp member defining with at least one other end forming member a throat cavity having said deformed cross section profile, said clamp member being biased toward said other end forming member and clamping and deforming said end portion of the workpiece on movement of the said one die section from the open to said intermediate position, and retracting relative to said one die section and remaining substantially stationary relative to said other die section on movement of said die section from the intermediate to the closed position.

12. A method as claimed in claim 11 wherein said clamp member clamps said one end of the workpiece before said one die section contacts the workpiece.

13. A method as claimed in claim 11 wherein said at least one other end forming member comprises a portion of a die section other than said at least one die section.

14. A method as claimed in claim 11 wherein said deforming step comprises forcing said neck into said interior region while laterally pressing said end portion toward said neck.

15. A method as claimed in claim 11 wherein said step of deforming said one opposite end comprises providing an end forming member, and urging said end forming member transversely inwardly toward said one opposite end.

16. A method as claimed in claim 15 wherein said end forming member has an inner side engaging said one opposite end, said inner side extending parallel to an axis of said one opposite end.

17. Method as claimed in claim 16 wherein the sealing tool comprises a base portion rearwardly of said coining portion of transverse width greater than an inner transverse width of said deformed transverse cross-section.

18. A method as claimed in claim 17 wherein said coining step comprises inserting said base portion axially inwardly with respect to said inner side of said end forming member and said one opposite end.

19. A method as claimed in claim 17 wherein said coining step comprises engaging an end surface of said one opposite end with said coining portion while maintaining said base portion axially outwardly from said end surface of said one opposite end.

20. A method as claimed in claim 17 wherein said end forming member has an end portion extending transversely outwardly from said inner side, and wherein said coining step comprises inserting said neck axially inwardly with respect to said end portion of said end forming member and said one opposite end and pinching said tubular workpiece between said coining portion and said inner side.

21. A method as claimed in claim 10 wherein said coining step causes a reduction in said wall thickness about 0.0001 to about 0.050 inch (about 0.003 to about 1.3 mm).

22. A method as claimed in claim 21 wherein said reduction in thickness is about 0.0015 to about 0.015 inch (about 0.04 to about 0.4 mm).

23. A method as claimed in claim 22 wherein said reduction is about 0.002 to about 0.011 inch (about 0.05 to about 0.3 mm).

* * * * *